US011056273B2

(12) United States Patent
Kanbe et al.

(10) Patent No.: US 11,056,273 B2
(45) Date of Patent: Jul. 6, 2021

(54) COIL COMPONENT

(71) Applicant: Murata Manufacturing Co., Ltd., Kyoto (JP)

(72) Inventors: Yuki Kanbe, Nagaokakyo (JP); Masahiro Bando, Nagaokakyo (JP); Kenta Hino, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/245,766

(22) Filed: Aug. 24, 2016

(65) Prior Publication Data

US 2017/0062122 A1 Mar. 2, 2017

(30) Foreign Application Priority Data

Aug. 28, 2015 (JP) ..... JP2015-168618

(51) Int. Cl.
*H01F 17/04* (2006.01)
*H01F 27/28* (2006.01)
(Continued)

(52) U.S. Cl.
CPC ..... *H01F 27/2823* (2013.01); *H01F 17/045* (2013.01); *H01F 27/24* (2013.01); *H01F 27/32* (2013.01); *H01F 2017/0093* (2013.01)

(58) Field of Classification Search
USPC ..... 336/206
See application file for complete search history.

(56) References Cited

U.S. PATENT DOCUMENTS 6,319,604 B1 * 11/2001 Xu ..... H01B 3/305 174/102 P
6,437,249 B1 * 8/2002 Higashiura ..... H01B 3/301 174/120 R
(Continued)

FOREIGN PATENT DOCUMENTS

CN 1241282 A 1/2000
CN 1661737 A 8/2005
(Continued)

OTHER PUBLICATIONS

Notification of the First Office Action issued by the State Intellectual Property Office of the People's Republic of China dated Oct. 30, 2017, which corresponds to Chinese Patent Application No. 201610591240.2 and is related to U.S. Appl. No. 15/245,766.
(Continued)

*Primary Examiner* — Ronald Hinson
(74) *Attorney, Agent, or Firm* — Studebaker & Brackett PC

(57) ABSTRACT

A coil component has a winding core part, and a plurality of wires that are wound on the winding core part to form a plurality of layers. The wires each include a conductor and a covering film that covers the conductor, an outer diameter of the wire of an n-th layer ("n" is an integer that is two or greater) is smaller than an outer diameter of the wire of an (n−1)th layer, an outer diameter of the conductor of the wire of the n-th layer is equal to an outer diameter of the conductor of the wire of the (n−1)th layer, and a thickness of the covering film of the wire of the n-th layer is smaller than a thickness of the covering film of the wire of the (n−1)th layer.

4 Claims, 6 Drawing Sheets

(51) Int. Cl.

| | |
|---|---|
| ***H01F 27/24*** | (2006.01) |
| ***H01F 27/32*** | (2006.01) |
| *H01F 17/00* | (2006.01) |

(56) References Cited

U.S. PATENT DOCUMENTS

| | | | | |
|---|---|---|---|---|
| 7,253,357 | B2 * | 8/2007 | Cipelli | H01B 3/306<br>174/110 R |
| 7,932,803 | B2 * | 4/2011 | Hirai | H01F 17/045<br>29/602.1 |
| 2010/0182115 | A1 * | 7/2010 | Huang | H01F 3/10<br>336/83 |
| 2014/0167903 | A1 * | 6/2014 | Tomonari | H01F 27/2823<br>336/220 |
| 2016/0133377 | A1 * | 5/2016 | Takagi | H01F 27/2823<br>336/192 |

FOREIGN PATENT DOCUMENTS

| | | | |
|---|---|---|---|
| CN | 101449346 | A | 6/2009 |
| JP | H07-042507 | U | 8/1995 |
| JP | H08-195319 | A | 7/1996 |
| JP | 2006-013064 | A | 1/2006 |
| JP | 2010-165863 | A | 7/2010 |
| JP | 2012-164928 | A | 8/2012 |
| WO | 2008/096487 | A1 | 8/2008 |

OTHER PUBLICATIONS

JP Office Action dated Mar. 6, 2018, from corresponding JP Appl No. 2015-168618, with English translation, 6 pp.

* cited by examiner

COIL COMPONENT

CROSS REFERENCE TO RELATED APPLICATIONS

This application claims benefit of priority to Japanese Patent Application No. 2015-168618 filed Aug. 28, 2015, the entire content of which is incorporated herein by reference.

TECHNICAL FIELD

The present disclosure relates to a coil component.

BACKGROUND

A coil component described in WO 2008/096487 has conventionally been present. This coil component includes a core, and first and second wires that are wound on the core. The first wire is directly wound on the core and the second wire is wound on the outer side of the first wire. The first wire constitutes a first layer to be a lower layer and the second wire constitutes a second layer to be an upper layer.

SUMMARY

Problems to be Solved by the Disclosure

When the traditional coil component is actually manufactured and used, presence of the following problems is found.

In the case where the two wires are wound for one to be vertically stacked on the other (to be wound in, what-is-called, bifilar winding), the thicknesses of the covering films of the two wires are different from each other and, when the wire with the covering film having the larger thickness is disposed in the second layer, the wire of the second layer tend to be untidily wound. As a result, problems arise that the property of the coil component cannot be acquired and that the property of the coil component significantly disperses.

An object of the present disclosure is to provide a coil component that prevents any untidy winding of the wires thereof and from which a stable property can be acquired.

Solutions to the Problems

To solve the problems, the coil component of the present disclosure includes:

a winding core part, and plural wires that are wound on the winding core part to form plural layers, wherein the wires each include a conductor and a covering film that covers the conductor, the outer diameter of the wire of the n-th layer ("n" is an integer that is two or greater) is smaller than the outer diameter of the wire of the (n−1)th layer, the outer diameter of the conductor of the wire of the n-th layer is equal to the outer diameter of the conductor of the wire of the (n−1)th layer, and the thickness of the covering film of the wire of the n-th layer is smaller than the thickness of the covering film of the wire of the (n−1)th layer.

The (n−1)th layer is positioned in a lower layer that is closer to the winding core part than the n-th layer is. The wire constituting the (n−1)th layer and the wire constituting the n-th layer are different from each other.

According to the coil component of the present disclosure, the outer diameter of the wire of the n-th layer is smaller than the outer diameter of the wire of the (n−1)th layer. An interspace can thereby be disposed between the wires adjacent to each other of the n-th layer, and the wire of the n-th layer can thereby be wound with a tension continuously applied thereto. As a result, in a cross section including the axis of the winding core part, the center of gravity of the wire of the n-th layer can be brought close to a bisector of a line that connects the centers of gravity of the wires adjacent to each other of the (n−1)th layer that are positioned immediately beneath the wire of the n-th layer. Any untidy winding of the wires can be prevented, a stable wire layered structure can be acquired, and a stable property of the coil component can be acquired.

The outer diameter of the conductor of the wire of the n-th layer is equal to the outer diameter of the conductor of the wire of the (n−1)th layer, and the thickness of the covering film of the wire of the n-th layer is smaller than the thickness of the covering film of the wire of the (n−1)th layer. The difference in the DC resistance can thereby be avoided between the conductor of the wire of the n-th layer and the conductor of the wire of the (n−1)th layer, and the property of the coil component can be stabilized.

In one embodiment of the coil component, in the cross section including an axis of the winding core part, the wire of the n-th layer is in contact with both of the wires of the (n−1)th layer that are adjacent to each other and that are positioned immediately beneath the wire of the n-th layer.

According to the embodiment, the wire of the n-th layer is in contact with both of the wires of the (n−1)th layer that are adjacent to each other and that are positioned immediately beneath the wire of the n-th layer, and the wire of the n-th layer can therefore be set to be in a stable posture and the wire layered structure can further be stabilized.

In one embodiment of the coil component, in a cross section including the axis of the winding core part, the wires adjacent to each other of the first layer are in contact with each other.

According to the embodiment, the wires adjacent to each other of the first layer are in contact with each other, and the wire of the first layer can therefore be set to be in a stable posture and the wire layered structure can further be stabilized.

In one embodiment of the coil component, in a cross section including the axis of the winding core part, the center of gravity of the wire of the n-th layer overlaps with a bisector of a line connecting centers of gravity of the wires of the (n−1)th layer that are adjacent to each other and that are positioned immediately beneath the wire of the n-th layer.

According to the embodiment, in the cross section including the axis of the winding core part, the center of gravity of the wire of the n-th layer overlaps with the bisector of the line connecting the centers of gravity of the wires adjacent to each other of the (n−1)th layer, and the wire layered structure can therefore be further stabilized.

In one embodiment of the coil component, in a cross section including the axis of the winding core part, the wires adjacent to each other of the n-th layer are not in contact with each other to have an interspace therebetween.

According to the embodiment, the wires adjacent to each other of the n-th layer are not in contact with each other to have an interspace therebetween, and the wire of the n-th layer can therefore be further tightly wound.

In one embodiment of the coil component, the thickness of the covering film of the wire of the n-th layer is smaller by 2 μm or larger than the thickness of the covering film of the wire of the (n−1)th layer.

According to the embodiment, the thickness of the covering film of the wire of the n-th layer is smaller by 2 μm or larger than the thickness of the covering film of the wire of the (n−1)th layer, and untidy winding of the wires can further be suppressed and the wire layered structure can further be stabilized.

Effect of the Disclosure

According to the coil component of the present disclosure, the outer diameter of the wire of the n-th layer is smaller than the outer diameter of the wire of the (n−1)th layer, and thereby any untidy winding of the wires can therefore be prevented, and a stable property can be acquired.

DETAILED DESCRIPTION

The present disclosure will be described in detail with reference to depicted embodiments.

First Embodiment

Figure 1:
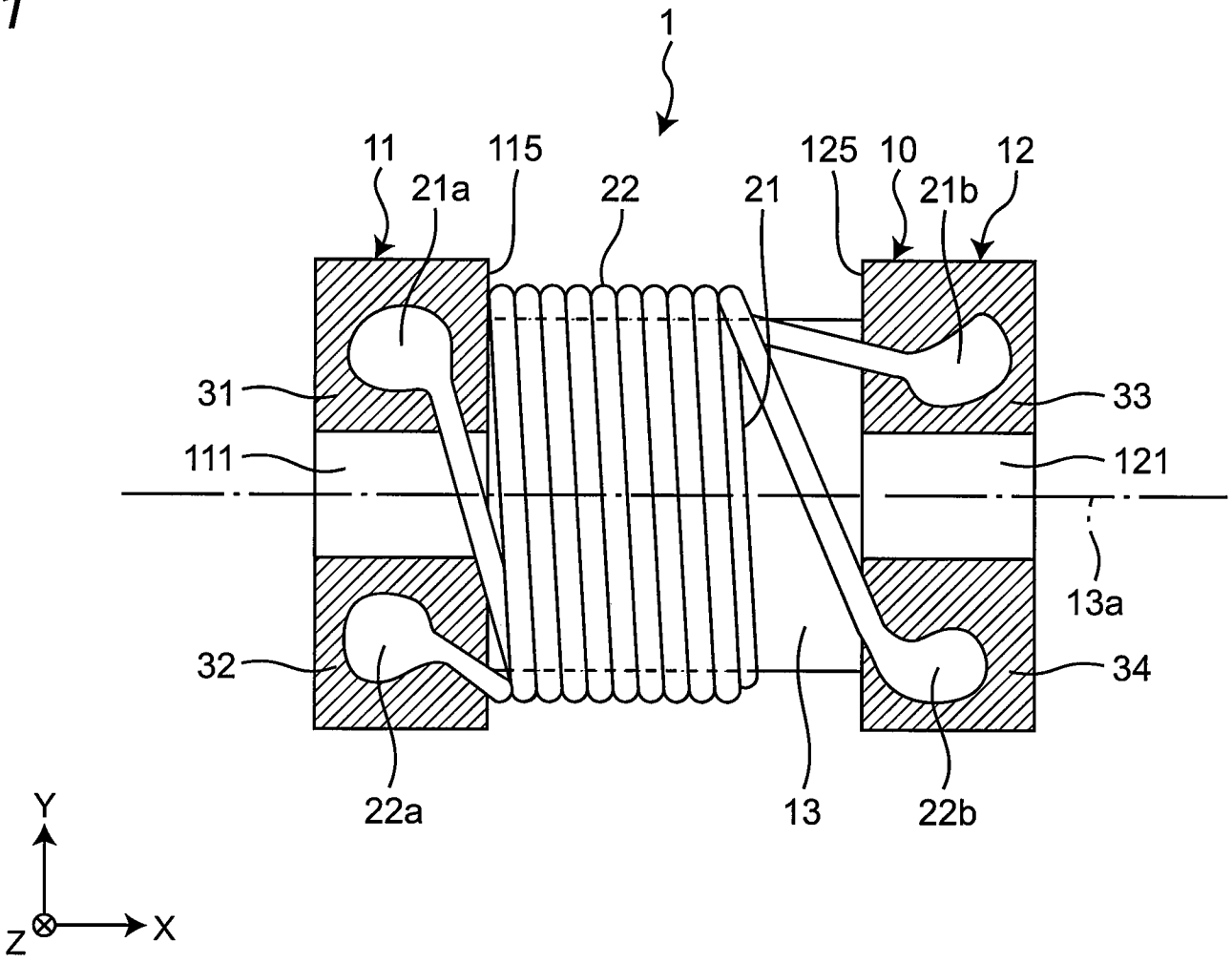
FIG. 1 is a bottom diagram of a first embodiment of a coil component of the present disclosure.
Figure 2:
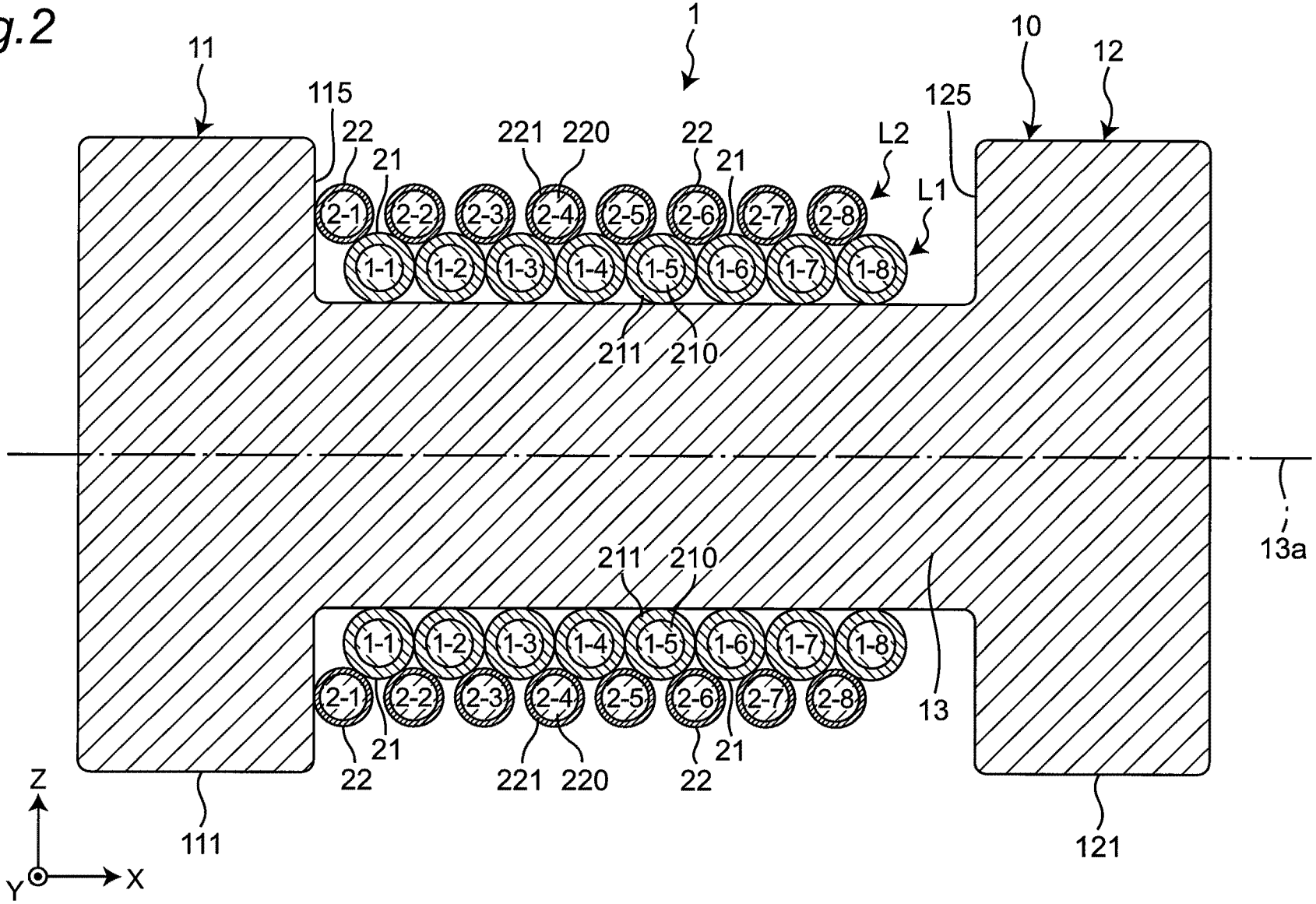
FIG. 2 is a cross-sectional diagram of the coil component.

FIG. 1 is a bottom diagram of a coil component of the first embodiment of the present disclosure. FIG. 2 is a cross-sectional diagram of the coil component. As depicted in FIG. 1 and FIG. 2, the coil component 1 functions as, for example, a common choke coil. The coil component 1 includes a core 10, four electrode parts 31 to 34 disposed on the core 10, and two wires 21 and 22 that are wound on the core 10 and that are connected to electrode parts 31 to 34.

The core 10 includes a winding core part 13, a first flange part 11 disposed on the one end in an axis 13*a* direction of the winding core part 13, and a second flange part 12 disposed on the other end in the axis 13*a* direction of the winding core part 13. A material such as, for example, alumina (a non-magnetic substance), or an Ni—Zn-based ferrite (a magnetic substance, an insulating substance) is used as the material of the core 10.

It is assumed in FIGS. 1 and 2 that the length direction of the coil component 1 (the axis 13*a* direction of the winding core part 13) is an X-direction, the width direction of the coil component 1 is a Y-direction, and the height direction of the coil component 1 is a Z-direction.

The winding core part 13 extends in the axis 13*a* direction. The shape of the winding core part 13 is a cuboid. The shape of the winding core part 13 may be another shape such as a columnar shape. The first flange part 11 includes an end face 115 connected to one end of the winding core part 13 and a bottom face 111 mounted on a mounting substrate. The second flange part 12 includes an end face 125 connected to the other end of the winding core part 13 and a bottom face 121 mounted on the mounting substrate.

The four electrode parts 31 to 34 are disposed on the bottom face 111 of the first flange part 11 and the bottom face 121 of the second flange part 12. The first and the second electrode parts 31 and 32 are arranged in the Y-direction on the bottom face 111 of the first flange part 11. The third and the fourth electrode parts 33 and 34 are arranged in the Y-direction on the bottom face 121 of the second flange part 12. The first and the third electrode parts 31 and 33 face each other in the X-direction. The second and the fourth electrode parts 32 and 34 face each other in the X-direction. The electrode parts 31 to 34 are electrically connected to electrodes of the mounting substrate by soldering, and the coil component 1 is thereby mounted on the mounting substrate.

The two wires 21 and 22 are wound along the axis 13*a* direction of the winding core part 13 to form two layers on the winding core part 13. The first wire 21 is directly wound on the winding core part 13 and the second wire 22 is wound on the outer side of the first wire 21. The first wire 21 constitutes a first layer L1 to be the lower layer and the second wire 22 constitutes a second layer L2 to be the upper layer. For example, the first layer L1 includes a first turn 1-1 to an eighth turn 1-8 of the first wire 21. The second layer L2 includes a first turn 2-1 to an eighth turn 2-8 of the second wire 22.

The first and the second wires 21 and 22 are wound being vertically stacked from the first flange part 11 toward the second flange part 12. The first and the second wires 21 and 22 are wound in, what-is-called, bifilar winding. The first turn 1-1 of the first wire 21 and the first turn 2-1 of the second wire 22 are simultaneously formed and, continuously and similarly, the second turns 1-2 and 2-2 to the eighth turns 1-8 and 2-8 are sequentially formed. As above, the first and the second wires 21 and 22 have the same winding direction and the same number of winding rotations (the number of turns).

One end 21*a* of the first wire 21 is electrically connected to the first electrode part 31 and the other end 21*b* of the first wire 21 is electrically connected to the third electrode part 33. One end 22*a* of the second wire 22 is electrically connected to the second electrode part 32 and the other end 22*b* of the second wire 22 is electrically connected to the fourth electrode part 34.

The first wire 21 includes a conductor 210 and a covering film 211 that covers the conductor 210. The second wire 22 includes a conductor 220 and a covering film 221 that covers the conductor 220. The conductors 210 and 220 each include, for example, Cu, Ag, Au, or the like. The covering films 211 and 221 each include an insulating resin such as, for example, polyurethane, polyester, or the like.

Figure 3:
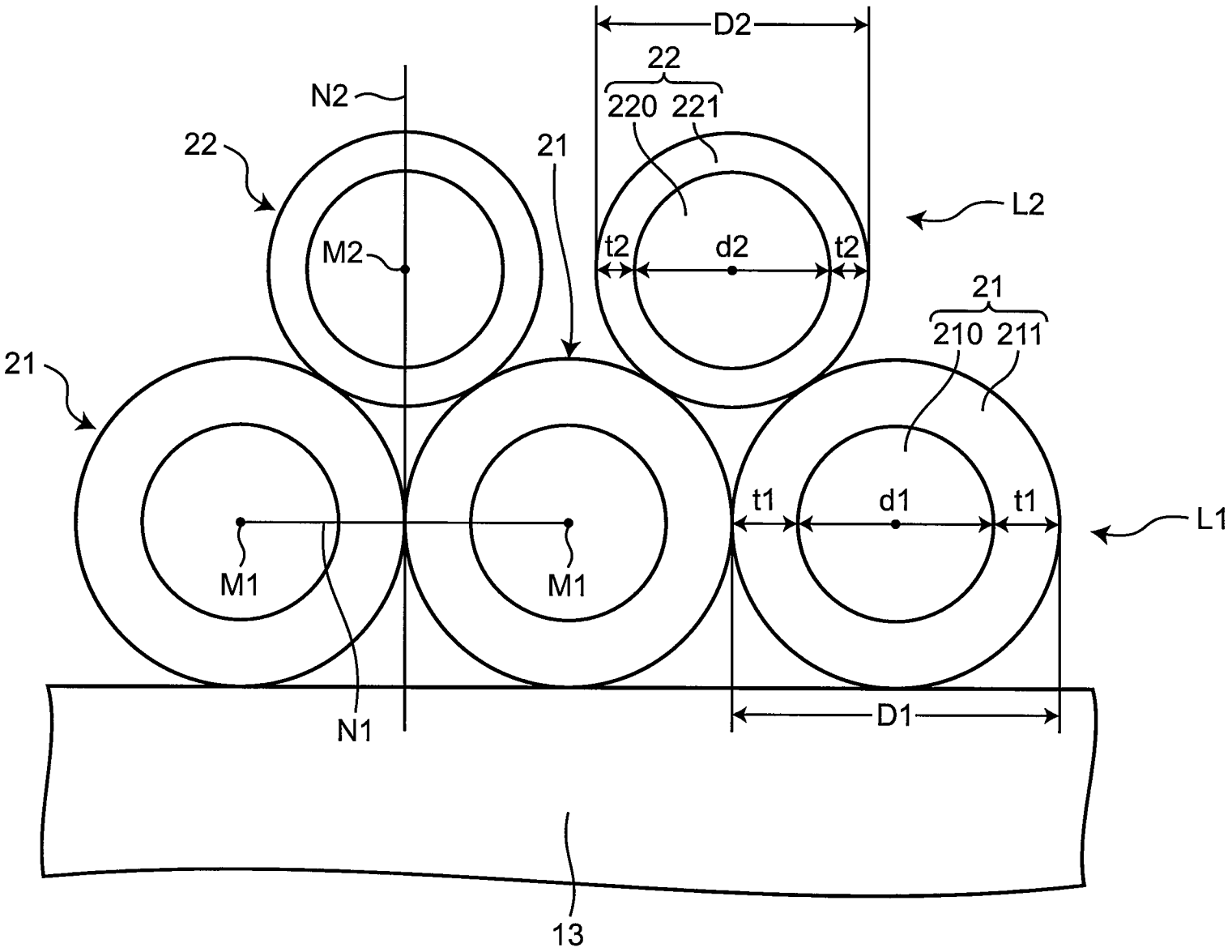
FIG. 3 is a partial enlarged diagram of FIG. 2.

FIG. 3 is a partial enlarged diagram of FIG. 2. As depicted in FIG. 2 and FIG. 3, an outer diameter D2 of the second wire 22 of the second layer L2 is smaller than an outer diameter D1 of the first wire 21 of the first layer L1. An outer diameter d2 of the conductor 220 of the second wire 22 of the second layer L2 is equal to an outer diameter d1 of the conductor 210 of the first wire 21 of the first layer L1, and a thickness t2 of the covering film 221 of the second wire 22 of the second layer L2 is smaller than a thickness t1 of the covering film 211 of the first wire 21 of the first layer L1. When the start of the winding or the end of the winding of the second wire 22 is positioned not in the second layer L2 but in the first layer L1, consideration will be made excluding the start of the winding and the end of the winding of the second wire 22. As preconditions, the wire constituting the first layer L1 and the wire constituting the second layer L2 are different from each other, and the second wire 22 positioned in the first layer L1 therefore does not constitute the first layer L1.

Preferably, in a cross section including the axis 13*a* of the winding core part 13, the second wire 22 of the second layer L2 is in contact with both of the first wires 21 and 21 of the first layer L1 that are adjacent to each other and that are positioned immediately beneath the second wire 22. Preferably, the first wires 21 and 21 adjacent to each other of the first layer L1 are in contact with each other.

Preferably, in the cross section including the axis 13*a* of the winding core part 13, the center of gravity M2 of the second wire 22 of the second layer L2 overlaps with a bisector N2 of a line N1 connecting centers M1 of gravity of the first wires 21 and 21 of the first layer L1 that are adjacent to each other and that are positioned immediately beneath the second wire 22. The centers M2 of gravity of all the second wires 22 of the second layer L2 overlap with the bisector N2. In this embodiment, the first and the second wires 21 and 22 each have a circular cross sectional shape, and the centers M1 and M2 of gravity match respectively with the centers of the wires 21 and 22. At least one of the centers M2 of gravity of the second wires 22 of the second layer L2 may be set to overlap the bisector N2. Otherwise, all of the centers M2 of gravity of the second wires 22 of the second layer L2 may each be set to be positioned in the vicinity of the bisector N2.

Preferably, the second wires 22 and 22 adjacent to each other of the second layer L2 are not in contact with each other and have an interspace therebetween. All the pairs of second wires 22 and 22 adjacent to each other of the second layer L2 each have the interspace therebetween. At least one of the pairs of second wires 22 and 22 adjacent to each other of the second layer L2 may be set to have the interspace.

Preferably, the thickness t2 of the covering film 221 of the second wire 22 of the second layer L2 is smaller by 2 μm or larger than the thickness t1 of the covering film 211 of the first wire 21 of the first layer L1. For example, the outer diameter d1 of the conductor 210 of the first wire 21 and the outer diameter d2 of the conductor 220 of the second wire 22 are each 70 μm, the thickness t1 of the covering film 211 of the first wire 21 is 10 μm, and the thickness t2 of the covering film 221 of the second wire 22 is 6 μm.

According to the coil component 1, the outer diameter D2 of the second wire 22 of the second layer L2 is smaller than the outer diameter D1 of the first wire 21 of the first layer L1. The interspace can thereby be disposed between the second wires 22 and 22 adjacent to each other of the second layer L2, and the second wire 22 of the second layer L2 can therefore be wound continuously applying a tension thereto. As a result, in the cross section including the axis 13*a* of the winding core part 13, the center M2 of gravity of the second wire 22 of the second layer L2 can be brought close to the bisector N2 of the line N1 that connects the centers M1 of gravity of the first wires 21 and 21 of the first layer L1 that are adjacent to each other and that are positioned immediately beneath the second wire 22. Any untidy winding of the second wire 22 can therefore be prevented and a stable layered structure of the second wire 22 can be acquired. A stable property of the coil component 1 can therefore be acquired.

The outer diameter d2 of the conductor 220 of the second wire 22 of the second layer L2 is equal to the outer diameter d1 of the conductor 210 of the first wire 21 of the first layer L1, and the thickness t2 of the covering film 221 of the second wire 22 of the second layer L2 is smaller than the thickness t1 of the covering film 211 of the first wire 21 of the first layer L1. The difference in the DC resistance can thereby be avoided between the conductor 220 of the second wire 22 of the second layer L2 and the conductor 210 of the first wire 21 of the first layer L1, and the property of the coil component 1 can be stabilized.

Preferably, the second wire 22 of the second layer L2 is in contact with both of the first wires 21 and 21 of the first layer L1 that are adjacent to each other and that are positioned immediately beneath the second wire 22, and the second wire 22 of the second layer L2 can thereby be set to be in a stable posture and the wire layered structure can further be stabilized.

Preferably, the first wires 21 and 21 adjacent to each other of the first layer L1 are in contact with each other, and the first wire 21 of the first layer L1 can therefore be set to be in a stable posture and the wire layered structure can further be stabilized.

Preferably, in the cross section including the axis 13*a* of the winding core part 13, the center M2 of gravity of the second wire 22 of the second layer L2 overlaps with the bisector N2 of the line N1 connecting the centers M1 of gravity of the first wires 21 and 21 of the first layer L1 that are adjacent to each other and that are positioned immediately beneath the second wire 22, and the layered structure of the second wire 22 can therefore be further stabilized.

Preferably, the second wires 22 and 22 adjacent to each other of the second layer L2 are not in contact with each other and have the interspace therebetween, and the second wire 22 of the second layer L2 can therefore further be tightly wound.

Preferably, the thickness t2 of the covering film 221 of the second wire 22 of the second layer L2 is smaller by 2 μm or larger than the thickness t1 of the covering film 211 of the first wire 21 of the first layer L1, and any untidy winding of the second wire 22 can therefore further be suppressed and the layered structure of the second wire 22 can further be stabilized.

Figure 4:
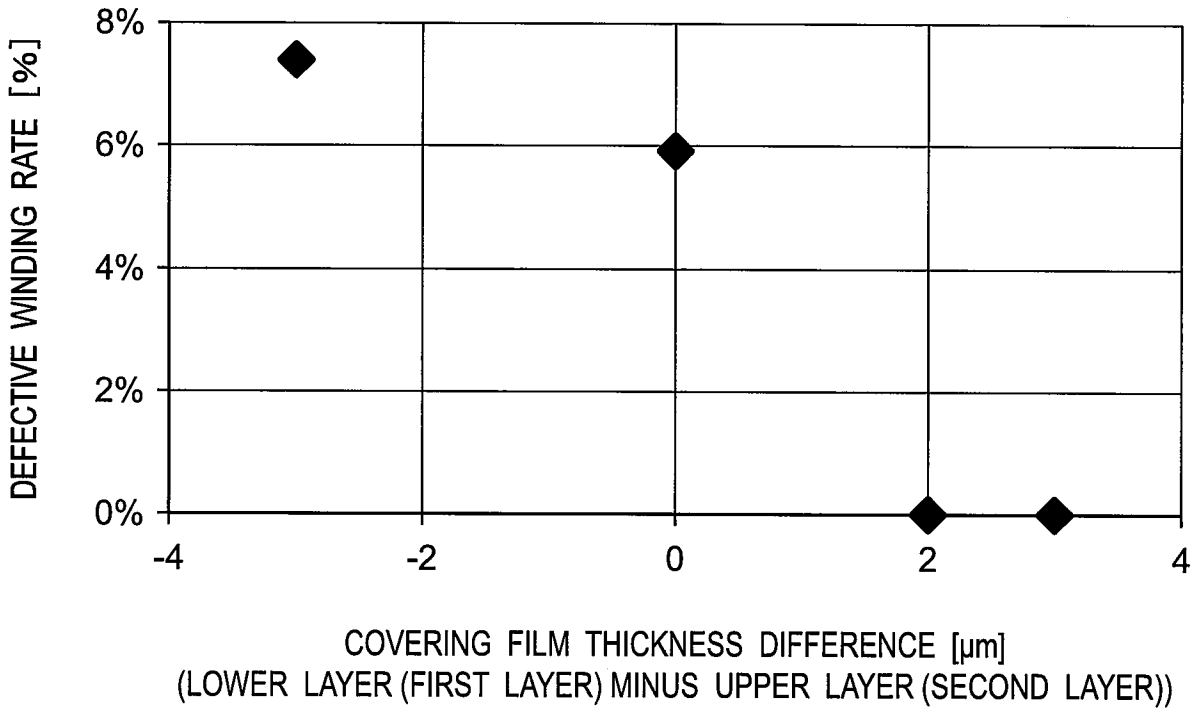
FIG. 4 is a graph of a relation between the covering film thickness difference and the defective winding rate.

FIG. 4 depicts the relationship between the difference [μm] between the thickness t1 of the covering film 211 of the first wire 21 of the first layer L1 (the lower layer) and the thickness t2 of the covering film 221 of the second wire 22 of the second layer L2 (the upper layer), and the defective winding rate [%]. As preconditions, the outer diameter d1 of the conductor 210 of the first wire 21 was 70 μm, the outer diameter d2 of the conductor 220 of the second wire 22 was 70 μm, the thickness t1 of the covering film 211 of the first wire 21 was 10 μm, and the thickness t2 of the covering film 221 of the second wire 22 was varied to research the defective winding rate.

In the above, the thicknesses t1 and t2 of the covering films 211 and 221 were measured by, for example, high precision cross section polishing and observation using a fluorescence microscope. For example, a laser displacement gauge or a transmission X-ray measuring device was used for measuring the thickness of the covering film. For example, the coil component was covered with a resin and the resin was hardened. The resin including the coil component was thereafter precisely polished in the direction perpendicular to the axis of the winding core part until the cross section of the winding core part became observable. The polished cross section was observed using a fluorescence microscope of 100 or greater magnifications. The covering film of the wire wound on the winding core part in the vicinity of the center thereof was measured. The thickness of the covering film of the wire was measured for each of five locations per one coil component, and the average of the measurements was taken as the thickness of the covering film of the wire of each of the layers.

The "defective winding rate" refers to the ratio of the number of coil components with defective winding to the total number of manufactured coil components in the manufacture of the coil component. The defective winding is classified into, for example, three types. The first type is defective winding formed as follows: the first wires 21 adjacent to each other are not in contact with each other except the start of the winding and the end of the winding to form an interspace therebetween and the second wire 22 falls into the interspace to be positioned in the first layer L1. The second type is defective winding formed as follows: the first wire 21 or the second wire 22 runs on itself or the other wire and three or more layers are thereby formed. The third type is defective winding formed as follows: the second wire 22 is wound in the second layer L2 forming an interspace corresponding to three or more outer diameters D1 of the first wire 21. The "untidy winding" and the "defective winding" have the same meaning.

As depicted in FIG. 4, the defective winding rate was 7.41% when the covering film thickness difference was −3 μm, the defective winding rate was 5.95% when the covering film thickness difference was 0 μm, the defective winding rate was 0% when the covering film thickness difference was 2 μm, and the defective winding rate was 0% when the covering film thickness difference was 3 μm. When the covering film thickness difference was equal to or larger than 2 μm, the defective winding rate was therefore 0% and any untidy winding of the second wire 22 was suppressed.

Second Embodiment

Figure 5:
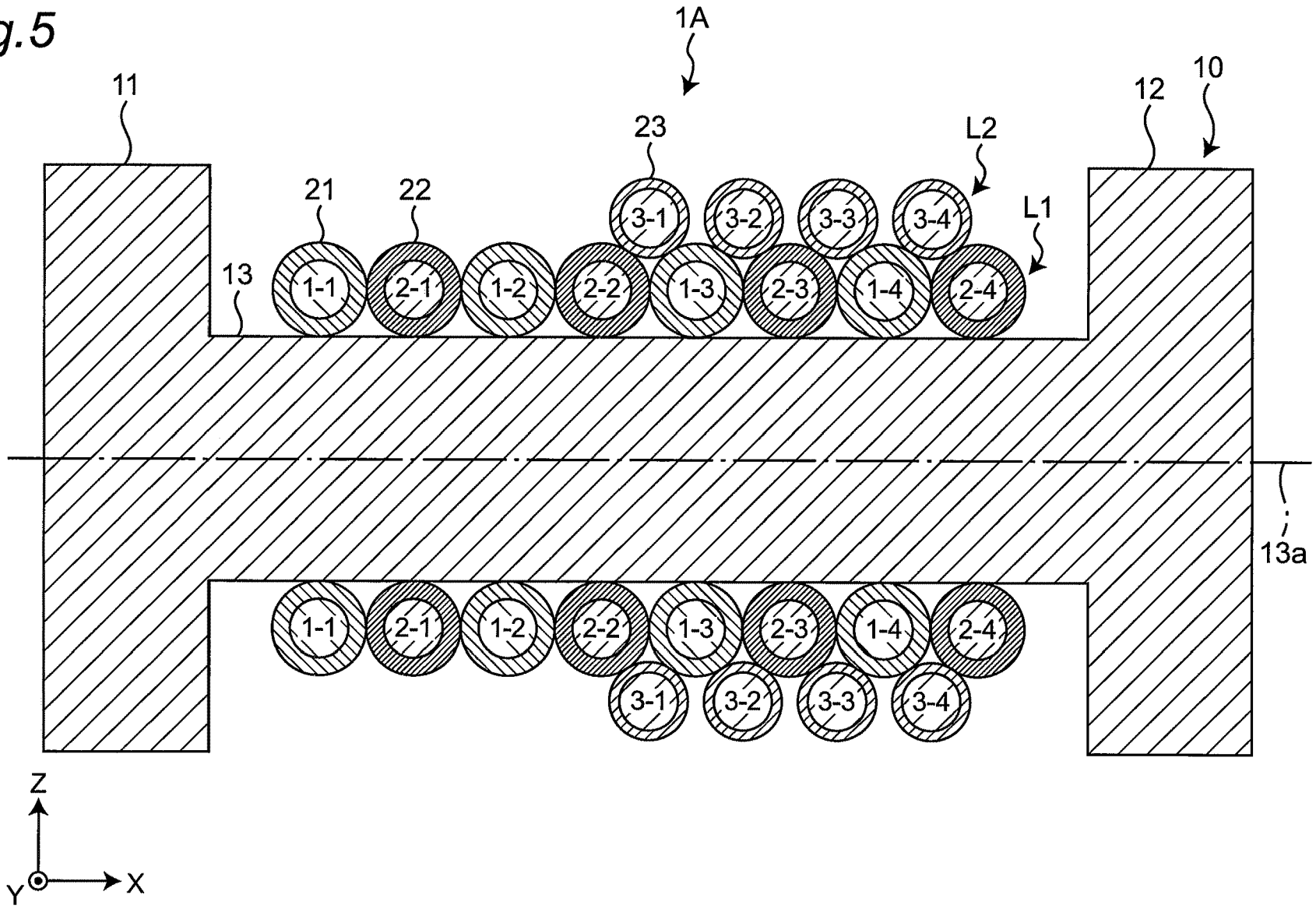
FIG. 5 is a cross-sectional diagram of a second embodiment of the coil component of the present disclosure.

FIG. 5 is a cross-sectional diagram of the second embodiment of the coil component of the present disclosure. The second embodiment is different from the first embodiment in the quantity of the wires. This different configuration will be described below. In the second embodiment, the same reference numerals as those of the first embodiment denote the same configurations as those of the first embodiment, and will not again be described.

As depicted in FIG. 5, in a coil component 1A of the second embodiment, the three wires 21, 22, and 23 are wound along the axis 13*a* of the winding core part 13 to form two layers on the winding core part 13. The first and the second wires 21 and 22 are directly wound on the winding core part 13, and the third wire 23 is wound on the outer side of the first and the second wires 21 and 22. The first and the second wires 21 and 22 constitute the first layer L1 to be the lower layer, and the third wire 23 constitutes the second layer L2 to be the upper layer. For example, the first layer L1 includes the first turn 1-1 to the fourth turn 1-4 of the first wire 21 and the first turn 2-1 to the fourth turn 2-4 of the second wire 22. The second layer L2 includes a first turn 3-1 to a fourth turn 3-4 of the third wire 23.

The first and the second wires 21 and 22 are wound in parallel to each other from the first flange part 11 toward the second flange part 12. The first and the second wires 21 and 22 are wound in what-is-called bifilar winding. The first and the second wires 21 and 22 are alternately arranged along the axis 13*a* direction of the winding core part 13. The first turn 1-1 of the first wire 21 and the first turn 2-1 of the second wire 22 are simultaneously formed and, continuously and similarly, the second turns 1-2 and 2-2 to the fourth turns 1-4 and 2-4 are sequentially formed. The first turn 3-1 to the fourth turn 3-4 of the third wire 33 are thereafter sequentially formed. As above, the first to the third wires 21 to 23 have the same winding direction and have the same number of winding rotations (the number of turns).

The outer diameter of the third wire 23 of the second layer L2 is smaller than each of the outer diameters of the first and the second wires 21 and 22 of the first layer L1. The outer diameter of a conductor of the third wire 23 of the second layer L2 is equal to each of the outer diameters of the conductors of the first and the second wires 21 and 22 of the first layer L1, and the thickness of a covering film of the third wire 23 of the second layer L2 is smaller than each of the thicknesses of the covering films of the first and the second wires 21 and 22 of the first layer L1. The thicknesses of the covering films of the first and the second wires 21 and 22 may be equal to each other or may be different from each other.

Similarly to the first embodiment, an interspace can therefore be disposed between the third wires 23 adjacent to each other of the second layer L2 and the third wire 23 of the second layer L2 can be wound with a tension continuously applied thereto. As a result, any untidy winding of the third wire 23 can be prevented, a stable layered structure of the third wire 23 can be acquired, and a stable property of the coil component 1A can be acquired.

Third Embodiment

Figure 6:
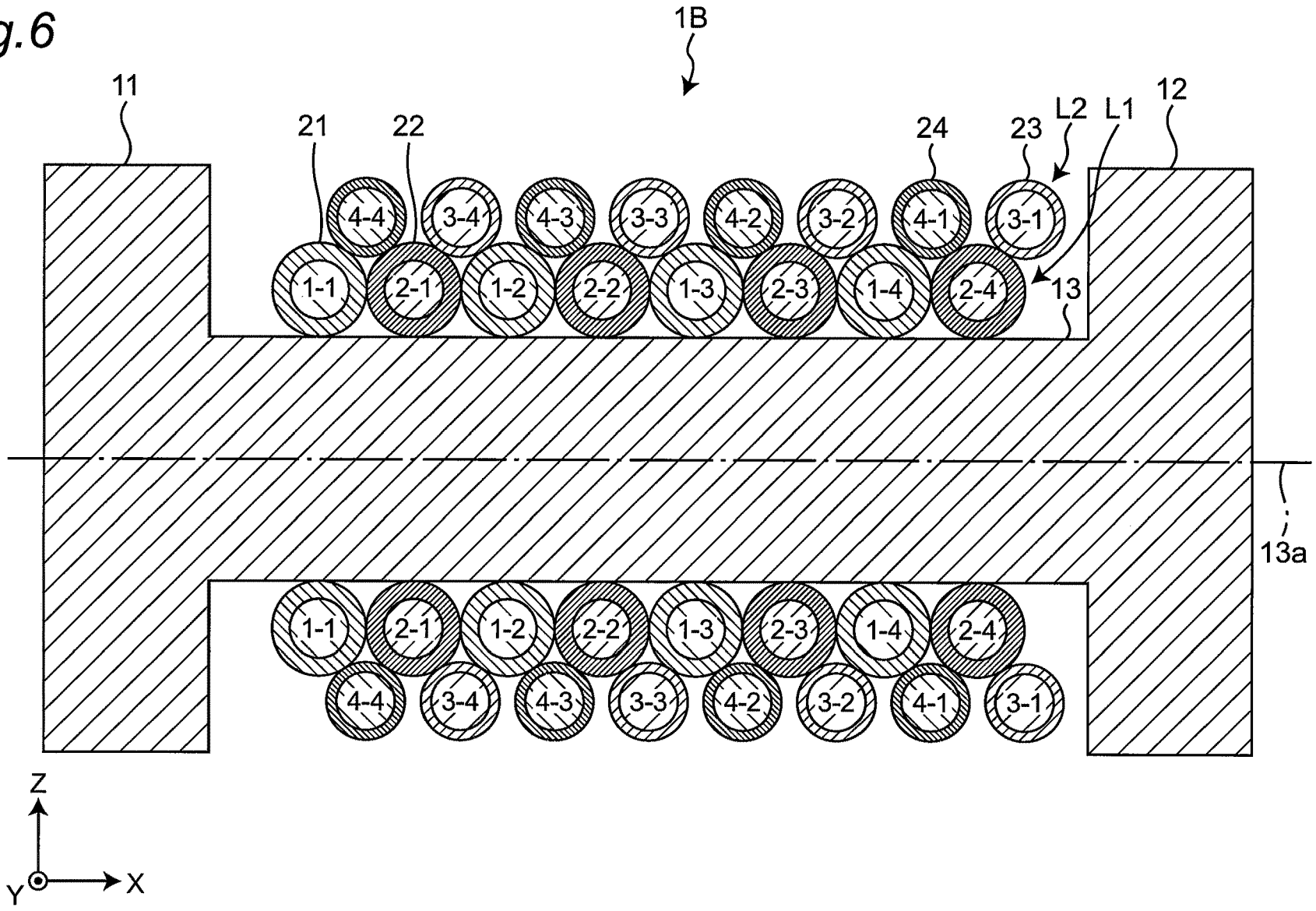
FIG. 6 is a cross-sectional diagram of a third embodiment of the coil component of the present disclosure.

FIG. 6 is a cross-sectional diagram of the third embodiment of the coil component of the present disclosure. The third embodiment is different from the first embodiment in the quantity of the wire. The different configuration will be described below. In the third embodiment, the same reference numerals as those of the first embodiment denote the same configurations as those of the first embodiment and will not again be described.

As depicted in FIG. 6, in a coil component 1B of the third embodiment, the four wires 21, 22, 23, and 24 are wound along the axis 13*a* direction of the winding core part 13 to form two layers on the winding core part 13. The first and the second wires 21 and 22 are directly wound on the winding core part 13, and the third and the fourth wires 23 and 24 are wound on the outer side of the first and the second wires 21 and 22. The first and the second wires 21 and 22 constitute the first layer L1 to be the lower layer, and the third and the fourth wires 23 and 24 constitute the second layer L2 to be the upper layer. For example, the first layer L1 includes the first turn 1-1 to the fourth turn 1-4 of the first wire 21 and the first turn 2-1 to the fourth turn 2-4 of the second wire 22. The second layer L2 includes the first turn 3-1 to the fourth turn 3-4 of the third wire 23 and a first turn 4-1 to a fourth turn 4-4 of the fourth wire 24.

The first and the second wires 21 and 22 are wound in parallel to each other from the first flange part 11 toward the second flange part 12. The first and the second wires 21 and 22 are wound in the what-is-called bifilar winding. The first and the second wires 21 and 22 are alternately arranged along the axis 13*a* direction of the winding core part 13. The first turn 1-1 of the first wire 21 and the first turn 2-1 of the second wire 22 are simultaneously formed and, continuously and similarly, the second turns 1-2 and 2-2 to the fourth turns 1-4 and 2-4 are sequentially formed.

On the other hand, the third and the fourth wires 23 and 24 are wound in parallel to each other from the second flange part 12 toward the first flange part 11. The third and the fourth wires 23 and 24 are wound in the what-is-called bifilar winding. The third and the fourth wires 23 and 24 are alternately arranged along the axis 13*a* direction of the winding core part 13. The first turn 3-1 of the third wire 23 and the first turn 4-1 of the fourth wire 24 are simultaneously formed and, continuously and similarly, the second turns 3-2 and 4-2 to the fourth turns 3-4 and 4-4 are sequentially formed.

As above, the first and the second wires 21 and 22 have the same winding direction and have the same number of winding rotations (the number of turns). The third and the fourth wires 23 and 24 have the same winding direction and have the same number of winding rotations (the number of turns).

The outer diameters of the third and the fourth wires 23 and 24 of the second layer L2 are each smaller than the outer diameters of the first and the second wires 21 and 22 of the first layer L1. The outer diameters of the conductors of the third and the fourth wires 23 and 24 of the second layer L2 are equal to the outer diameters of the conductors of the first and the second wires 21 and 22 of the first layer L1, and the thicknesses of the covering films of the third and the fourth wires 23 and 24 of the second layer L2 are each smaller than the thicknesses of the covering films of the first and the second wires 21 and 22 of the first layer L1. The outer diameters of the first and the second wires 21 and 22 may be equal to each other or may be different from each other. The outer diameters of the third and the fourth wires 23 and 24 may be equal to each other or may be different from each other. The thicknesses of the covering films of the first and the second wires 21 and 22 may be equal to each other or may be different from each other. The thicknesses of the covering films of the third and the fourth wires 23 and 24 may be equal to each other or may be different from each other.

Similarly to the first embodiment, an interspace can therefore be disposed between the third and the fourth wires 23 and 24 adjacent to each other of the second layer L2, and the third and the fourth wires 23 and 24 of the second layer L2 can be wound each with a tension continuously applied thereto. As a result, untidy winding of each of the third and the fourth wires 23 and 24 can be prevented, a stable layered structure of the third and the fourth wires 23 and 24 can be acquired, and a stable property of the coil component 1B can be acquired.

The present disclosure is not limited to the embodiments, and their designs can be changed within the scope not departing from the gist of the present disclosure. For example, the features of each of the first to the third embodiments may variously be combined with each other.

Though two to four wires are used in the embodiments, five or more wires may be used.

Though the two layers are formed by the wires in the embodiments, three or more layers may be formed. In this case, the outer diameter of the wire of the n-th layer is smaller than the outer diameter of the wire of the (n−1)th layer, the outer diameter of the conductor of the wire of the n-th layer is equal to the outer diameter of the conductor of the wire of the (n−1)th layer, and the thickness of the covering film of the wire of the n-th layer is smaller than the thickness of the covering film of the wire of the (n−1)th layer. As a precondition, the wire constituting the (n−1)th layer and the wire constituting the n-th layer are different from each other.

For example, when four layers are formed using four wires, the first layer is formed using the first wire, the second layer is formed using the second wire, the third layer is formed using the third wire, and the fourth layer is formed using the fourth wire. In order from the first wire of the first layer to the fourth wire of the fourth layer, the outer diameters of the wires sequentially become smaller and the thicknesses of the coverings films of the wires sequentially become smaller.

Though the coil component is a common choke coil in each of the embodiments, the coil component may be a coil component other than the common choke coil.

The invention claimed is:

1. A common choke coil comprising:

a winding core part, and a first wire and a second wire that are wound on the winding core part to form a first layer and a second layer, respectively, wherein the first and second wires each include a conductor and only one covering film that individually covers the conductor, an outer diameter of the second wire constituting the second layer is smaller than an outer diameter of the first wire constituting the first layer, an outer diameter of the conductor of the second wire constituting the second layer is equal to an outer diameter of the conductor of the first wire constituting the first layer, and a thickness of the covering film of the second wire constituting the second layer is smaller than a thickness of the covering film of the first wire constituting the first layer, wherein the covering film of each of the first and second wires consists of only one layer consisting of resin material, and the number of turns of the second wire constituting the second layer is the same as the number of turns of the first wire constituting the first layer, wherein the common choke coil further comprises:

a first flange part disposed on one end in an X-direction that is an axis direction of the winding core part, and a second flange part disposed on the other end in the X-direction, each of the first and second flange parts having a bottom face on one end in a Z-direction that is perpendicular to the X-direction; and first and second electrode parts which are arranged in a Y-direction that is perpendicular to the X-direction and the Z-direction on the bottom face of the first flange part, and third and fourth electrode parts which are arranged in the Y-direction on the bottom face of the second flange part, wherein the first and third electrode parts face each other in the X-direction, the second and fourth electrode parts face each other in the X-direction, and one end of the first wire is electrically connected to the first electrode part and the other end of the first wire is electrically connected to the third electrode part, one end of the second wire is electrically connected to the second electrode part and the other end of the second wire is electrically connected to the fourth electrode part, wherein in a cross section including an axis of the winding core part, the first wires adjacent to each other and constituting the first layer have portions that are in contact with each other, and in the cross section including the axis of the winding core part, the second wires adjacent to each other and constituting the second layer are not in contact with each other to have an interspace therebetween.

2. The common choke coil according to claim 1, wherein in the cross section including the axis of the winding core part, the second wire constituting the second layer is in contact with both of the first wires constituting the first layer that are adjacent to each other and that are positioned immediately beneath the second wire constituting the second layer.

3. The common choke coil according to claim 1, wherein in the cross section including the axis of the winding core part, a center of gravity of the second wire constituting the second layer overlaps with a bisector of a line that connects centers of gravity of the first wires constituting the first layer that are adjacent to each other and that are positioned immediately beneath the second wire constituting the second layer, the bisector being perpendicular to the axis of the winding core part.

4. A common choke coil comprising:

a winding core part, and a first wire and a second wire that are wound on the winding core part to form a first layer and a second layer, respectively, wherein the first and second wires each include a conductor and only one covering film that individually covers the conductor, an outer diameter of the second wire constituting the second layer is smaller than an outer diameter of the first wire constituting the first layer, an outer diameter of the conductor of the second wire constituting the second layer is equal to an outer diameter of the conductor of the first wire constituting the first layer, and a thickness of the covering film of the second wire constituting the second layer is smaller than a thickness of the covering film of the first wire constituting the first layer, wherein the covering film of each of the first and second wires consists of only one layer consisting of resin material, the thickness of the covering film of the second wire constituting the second layer is smaller by at least 2 μm than the thickness of the covering film of the first wire constituting the first layer, and the number of turns of the second wire constituting the second layer is the same as the number of turns of the first wire constituting the first layer, wherein the common choke coil further comprises:

a first flange part disposed on one end in an X-direction that is an axis direction of the winding core part, and a second flange part disposed on the other end in the X-direction, each of the first and second flange parts having a bottom face on one end in a Z-direction that is perpendicular to the X-direction; and first and second electrode parts which are arranged in a Y-direction that is perpendicular to the X-direction and the Z-direction on the bottom face of the first flange part, and third and fourth electrode parts which are arranged in the Y-direction on the bottom face of the second flange part, wherein the first and third electrode parts face each other in the X-direction, the second and fourth electrode parts face each other in the X-direction, and one end of the first wire is electrically connected to the first electrode part and the other end of the first wire is electrically connected to the third electrode part, one end of the second wire is electrically connected to the second electrode part and the other end of the second wire is electrically connected to the fourth electrode part, wherein in a cross section including an axis of the winding core part, the first wires adjacent to each other and constituting the first layer have portions that are in contact with each other, and in the cross section including the axis of the winding core part, the second wires adjacent to each other and constituting the second layer are not in contact with each other to have an interspace therebetween.

* * * * *